US006161735A

United States Patent [19]

Uchiyama et al.

[11] Patent Number: 6,161,735

[45] Date of Patent: Dec. 19, 2000

[54] SPOUTING STRUCTURE FOR AEROSOL VESSELS

[75] Inventors: Tsuyoshi Uchiyama; Ariko Imaoji, both of Tokyo, Japan

[73] Assignee: Taisho Pharmaceutical Co., Ltd., Japan

[21] Appl. No.: 09/294,095

[22] Filed: Apr. 19, 1999

[51] Int. Cl.[7] ..... B65D 83/00

[52] U.S. Cl. ..... 222/402.13; 222/547; 239/589; 239/337

[58] Field of Search ..... 222/402.1, 402.13, 222/564, 547; 239/573, 574, 589, 590, 337

[56] References Cited

U.S. PATENT DOCUMENTS

| | | | |
|---|---|---|---|
| 3,101,876 | 8/1963 | Ayres | 222/402.1 |
| 3,144,174 | 8/1964 | Abplanalp | 222/402.1 |
| 3,404,814 | 10/1968 | Wakeman | 222/402.1 |
| 4,526,593 | 7/1985 | Meyerson | 222/547 |
| 5,975,356 | 11/1999 | Yquel et al. | 222/402.1 |

FOREIGN PATENT DOCUMENTS

| | | | |
|---|---|---|---|
| 53-15276 | 2/1978 | Japan | 222/402.1 |
| 1198189 | 6/1988 | United Kingdom | 222/402.1 |
| 2219352 | 12/1989 | United Kingdom | 222/402.13 |

*Primary Examiner*—Andres Kashnikow
*Assistant Examiner*—Jorge Bocanegra
*Attorney, Agent, or Firm*—Lorusso & Loud

[57] ABSTRACT

The present invention is intended to provide a dispenser structure for aerosol containers, which can control the discharge rate of aerosol and ensure satisfactory and safe dispensing of the aerosol while preventing the particle size of the dispensed aerosol from becoming too fine and preventing its excessive scattering which too fine particles would entail. Its structure is characterized in that it includes a dispenser (1) provided with a dispensing guide or first nozzle (11) communicating with a dispensing valve (2); a second nozzle (10) provided within the dispensing guide or first nozzle (11) and having a smaller dispensing port (10a) whose bore d is not more than 0.5 mm; and a larger dispensing port (1a) having a bore b of 0.8 to 3 mm and a length c of not less than 5 mm, formed within the dispensing guide or first nozzle (11) downstream, in the direction of dispensing from the second nozzle (10).

9 Claims, 7 Drawing Sheets

SPOUTING STRUCTURE FOR AEROSOL VESSELS

BACKGROUND OF THE INVENTION

1. Field of the Invention

The present invention relates to a dispensing structure for aerosol containers, and more specifically to a dispensing structure for aerosol containers, designed for satisfactory dispensing of aerosol while controlling the discharge rate of the aerosol contained within.

2. Description of the Prior Art

The basic configuration of an aerosol container to which a dispensing structure according to the prior art is applied will be described below with reference to the accompanying FIG. 4.

In the aerosol container according to the prior art, a cup (20) having a dispensing valve (2) at the center is fitted hermetically to the aperture of a container (3) by clinching the cup body (21) together with the curled lip (31) of the container (3).

The dispensing valve (2) is formed by inserting a spring (25) through the aperture of a housing (23), fitting a valve stem (24) having a prescribed inside diameter (e.g. ϕ 0.33 mm) into the housing (23) with a prescribed gap in-between, and hermetically caulking the housing (23) into the central part of the cup (20) via a gasket (22), with the top part of the valve stem (24) protruding out.

The housing (23) has a lower port (23') communicating with the inside of the container (3), and the valve stem (24) has an upper port (24') communicating with the inside of the housing (23). The lower port (23') is always in communication with the container (3), while the upper port (24') is usually blocked by the gasket (22) as the valve stem (24) is pressed upward by the spring (25).

The top end of the valve stem (24) protruding out of the cup (20) closely communicates with a pipe-shaped spout (1).

The spout (1) has an integrated insert **(11*a*) in the central part of a pipe-shaped dispensing guide toward its base end as well as a cap section (13) integrated with the outer circumference of this insert (11*a*). The top end of the valve stem (24) is inserted into the insert (11*a*), and the cap section (13) is fitted around the seamed edges (21) and (31) of the container (3)**.

The spout (1), so shaped that the dispensing guide (11) protruding upward from the cap section (13) is bent in a dogleg form, is designed to have a bore (f) of, for instance, 1.5 mm and a length (g) of 19 mm.

The aerosol to be filled into the container (3) consists of a solution prepared by blending various ingredients and an aerosol propellant, consisting of a liquefied gas having a prescribed gas pressure. Therefore, the aforementioned aerosol container is given a prescribed internal pressure by the gas pressure of the aerosol propellant.

The aerosol container is so configured that when a manipulative piece (13a) on the cap section (13) of the spout (1) is pressed, the valve stem (24) moves downward, and the concurrent descent of the position of the upper port (24') causes the container (3), the housing (23) and the spout (1) to communicate with one another and thereby the aerosol filling the container (3) to be dispensed from the spout (1).

It is usual for an aerosol container of the type described above to be fitted with a nozzle (12) having a small diameter port **(12*a*) (of about 0.5 mm in bore) at the tip of the spout (1), as illustrated in the accompanying FIG. 5**, as a means to control the discharge rate of the aerosol per unit length of time.

The spout (1) shown in FIG. 5, because the bore at its tip is smaller than that of the spout shown in FIG. 4, can better control the discharge rate of aerosol. However, the spout (1) illustrated in FIG. 5 involves the following problems.

First, as the formation of the smaller dispensing port **(12*a*) at the tip of the spout (1) results in a corresponding smaller cross-sectional area of the tip, the dispensing pressure at the tip is greater than at the tip of the spout (1) shown in FIG. 1 when the aerosol is dispensed. Therefore, when the aerosol is dispensed from the smaller dispensing port (12*a*)** externally (into the atmosphere), the vaporization of the propellant contained in the aerosol is suddenly accelerated, resulting in an increase in the quantity of fine particles with possible hazard to the safety of humans who happen to inhale the mist, depending on the recipe of the aerosol.

Second, the finer particles mean that the dispensed aerosol will scatter over a greater area, and contaminate and/or wastefully involve unintended parts with the scattering aerosol.

Third, where the aerosol is characterized by a sense of coolness the heat of vaporization of the propellant enables its user to feel, the acceleration of its vaporization invites the problem of weakening this sense of coolness.

An object of the present invention is to provide a dispensing structure for aerosol containers, which can control the discharge rate of aerosol and ensure satisfactory and safe dispensing of the aerosol while preventing the particle size of the dispensed aerosol from becoming too fine and its excessive scattering which too fine particles would entail.

Other objects and features of the invention will become apparent to those skilled in the art from the following description.

SUMMARY OF THE INVENTION

According to the invention, there is provided a dispensing structure for aerosol containers, comprising:

- a spout (1) provided with a dispensing guide (11) communicating with a dispensing valve (2);
- a thin nozzle (10) provided within the nozzle or dispensing guide (11) and having a smaller dispensing port **(10*a*)** whose bore d is not more than 0.5 mm; and
- a larger dispensing port **(1*a*) having a bore b of 0.8 to 3 mm and a length c of not less than 5 mm, formed within the dispensing guide (11) farther ahead in the dispensing direction than the thin nozzle (10)**.

BRIEF DESCRIPTION OF THE DRAWINGS

It is to be understood that, in the following description, main elements similar to corresponding ones in the aerosol container shown in FIG. 4 and in any conventional structure are assigned the same reference numerals, and their description is dispensed with wherever practicable.

DESCRIPTION OF THE PREFERRED EMBODIMENTS

Dispensing structures for aerosol containers according to the invention will be described in further detail with reference to a number of embodiments illustrated in the accompanying drawings.

EMBODIMENT 1

Figure 1:
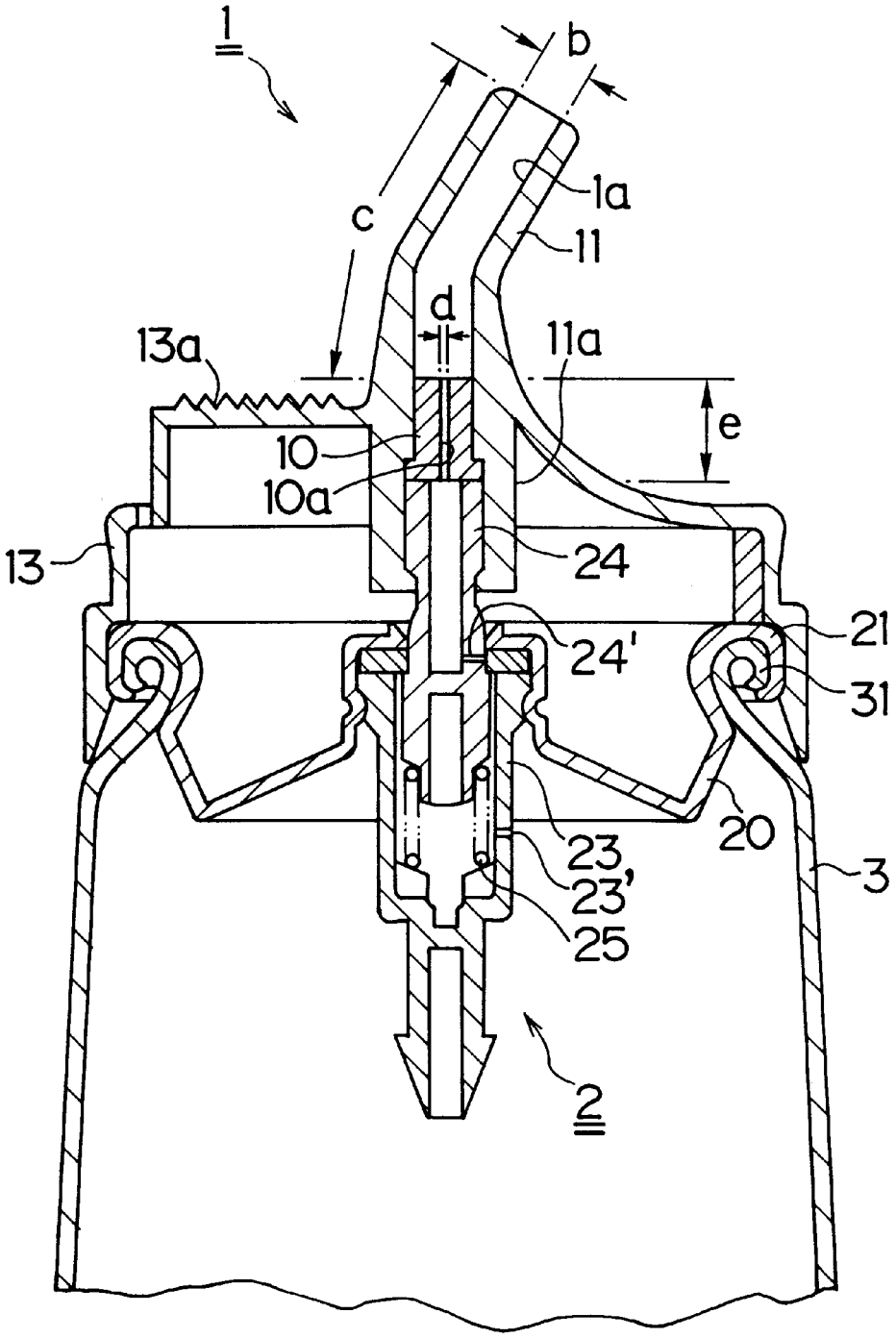
FIG. 1 is a partial cross-sectional view of a first embodiment of a dispensing structure for aerosol containers according to the present invention.

The first embodiment of the invention, illustrated in FIG. 1, has a dispensing structure for aerosol containers in which a cup (20) with an aperture is tightly caulked within a container (3), which is filled with an aerosol.

A thin nozzle (10) having a smaller dispensing port (10*a*) is hermetically inserted into a pipe-shaped spout (1) toward its base end, and a larger dispensing port (1*a*) is formed toward the tip of the thin nozzle (10).

In the spout (1) described above, the larger dispensing port (1*a*) may have a bore b of 0.8 to 3 mm, more preferably 1 to 2 mm, and a length c of not less than 5 mm, more preferably between 8 and 40 mm, and the smaller dispensing port (10*a*) may have a bore d of not more than 0.5 mm, more preferably 0.2 to 0.5 mm, and a length e of 2 to 20 mm, more preferably between 4 and 10 mm.

There is no particular limitation to the choice of the aerosol to fill the container (3), but it may be selected from a great variety of available aerosols; the ingredients of a typical example of aerosol that can be packaged and their respective quantities are listed below.

| Component | Quantity |
|---|---|
| Solution to be sprayed | |
| Lidocaine | 0.6 g |
| Menthol | 0.3 g |
| Polyoxyethylene (20) Sorbitan monostearate | 0.6 g |
| Polyoxyethylene (20) Sorbitan tristearate | 0.9 g |
| Sorbitan monostearate | 0.6 g |
| Ethyl alcohol | 10.5 g |
| Purified water | 30 ml in total |
| Aerosol propellant | |
| Dimethyl ether | 70 ml |

After filling the container (3) with a solution to be sprayed, prepared uniformly by heating, mixing and stirring the ingredients in the above-stated recipe, the container (3) is tightly closed with a cup (20) having a dispensing valve (2), and the aerosol is filled through the upper aperture of a valve stem (24) by a compressed gas packing method and the container (3) is thereby filled with the aerosol.

The aerosol of the above-stated recipe is given a gauge pressure of about 4 kgf/cm$^2$ within the container (3) by the gas pressure of the propellant dimethyl ether.

Next will be described the dispensing of an aerosol using an aerosol container having the dispensing structure of this embodiment.

Pressing a manipulative piece (13*a*) of the spout (1), when the container (3) is held upside down, lowers the position of an upper port (24') together with the valve stem (24) to achieve communication among the inside of the container (3), that of a housing (23), the hollow in the valve stem (24), the smaller spouting port (10*a*) and the larger dispensing port (1*a*), with the result that the aerosol packed within the container (3) is dispensed by the internal pressure from the smaller dispensing port (10*a*) to the larger dispensing port (1*a*).

Since the smaller dispensing port (10*a*) is smaller in bore, the quantity of the aerosol dispensed from this smaller dispensing port (10*a*) to the larger dispensing port (1*a*) is restricted.

As the larger dispensing port (1*a*) downstream of the smaller dispensing port (10*a*) is greater in bore and is not shorter than a prescribed length, the fluid resistance drops stepwise and rapidly within the larger dispensing port (1*a*). Therefore, the dispensing pressure at the tip of the larger spouting port (1*a*) is lower than that at the tip of the smaller dispensing port (10*a*) or of a smaller dispensing port (12*a*) in FIG. 5, and is closer to the atmospheric pressure (0 kgf/cm$^2$ in gauge pressure), with the result that the vaporization of the propellant is restrained, and the dispensed particles do not become finer, but are discharged into the atmosphere, retaining a prescribed average particle size (e.g., about 70 $\mu$m).

To summarize, if the length c of the larger dispensing port (1*a*) is not more than 5 mm or its bore b is less than 0.8 mm, the vaporization of the propellant will not be adequately restrained because the fluid resistance does not drop sufficiently in the larger dispensing port (1*a*), so that the dispensed particles become finer (to e.g. 70 $\mu$m or less).

Figure 5:
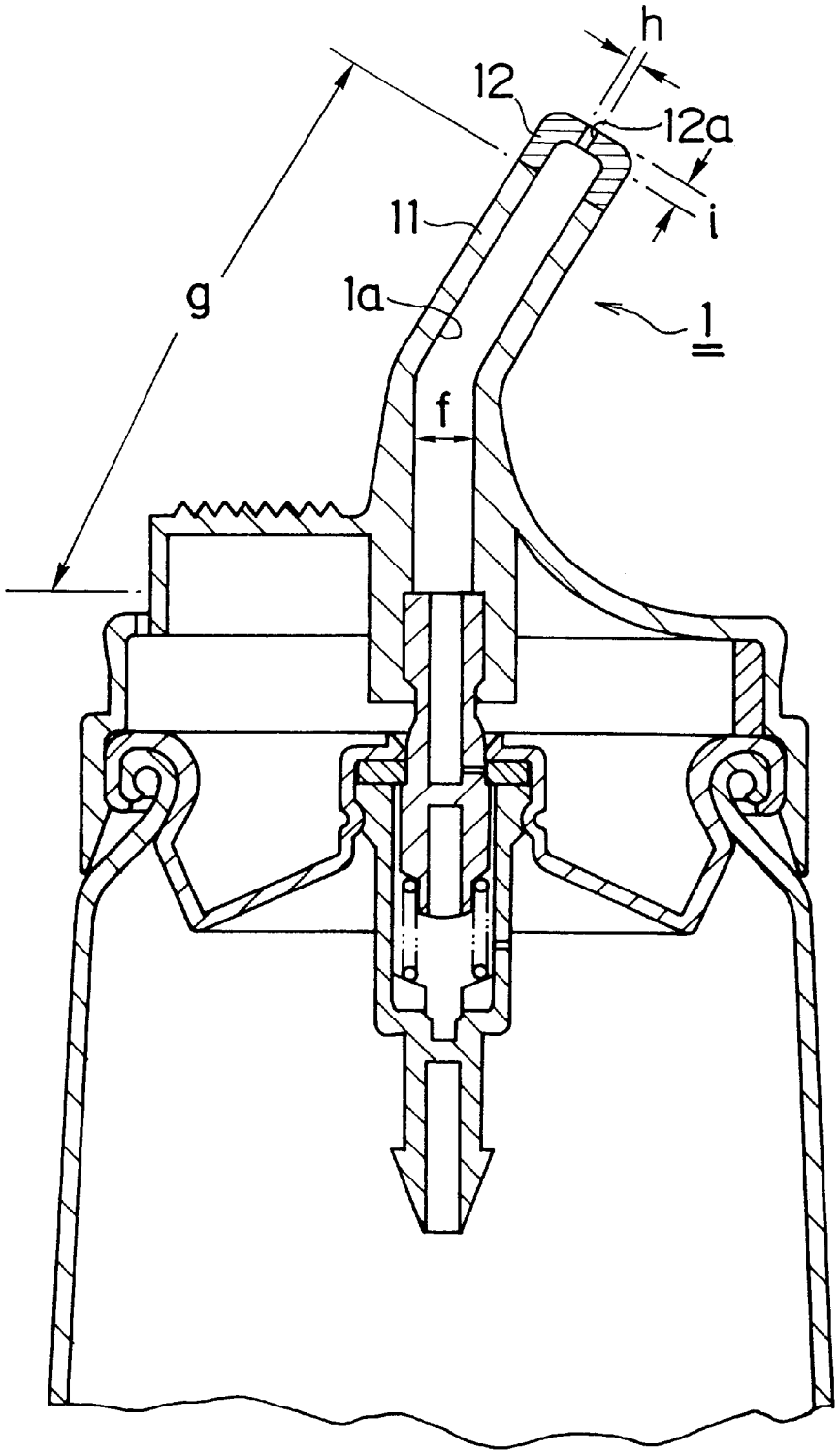
FIG. 5 is a partial cross-sectional view of another dispensing structure for aerosol containers according to the prior art, shown for comparison with the dispensing structure for aerosol containers illustrated in FIG. 1.

In the dispensing structure illustrated in FIG. 5, for example, when the aerosol is dispensed through the smaller dispensing hole (12*a*) directly into the atmosphere, i.e., a free and large space, it immediately vaporizes and rapidly diffuses.

By contrast, in the dispenser of the above-described first embodiment of the present invention, the aerosol passes the larger dispensing port (1*a*) of a prescribed length before it is discharged into the atmospheric space after passing through the smaller dispensing port (10*a*) as described above, resulting in the advantage that the average size of the dispensed particles never decreases beyond a prescribed level.

Figure 4:
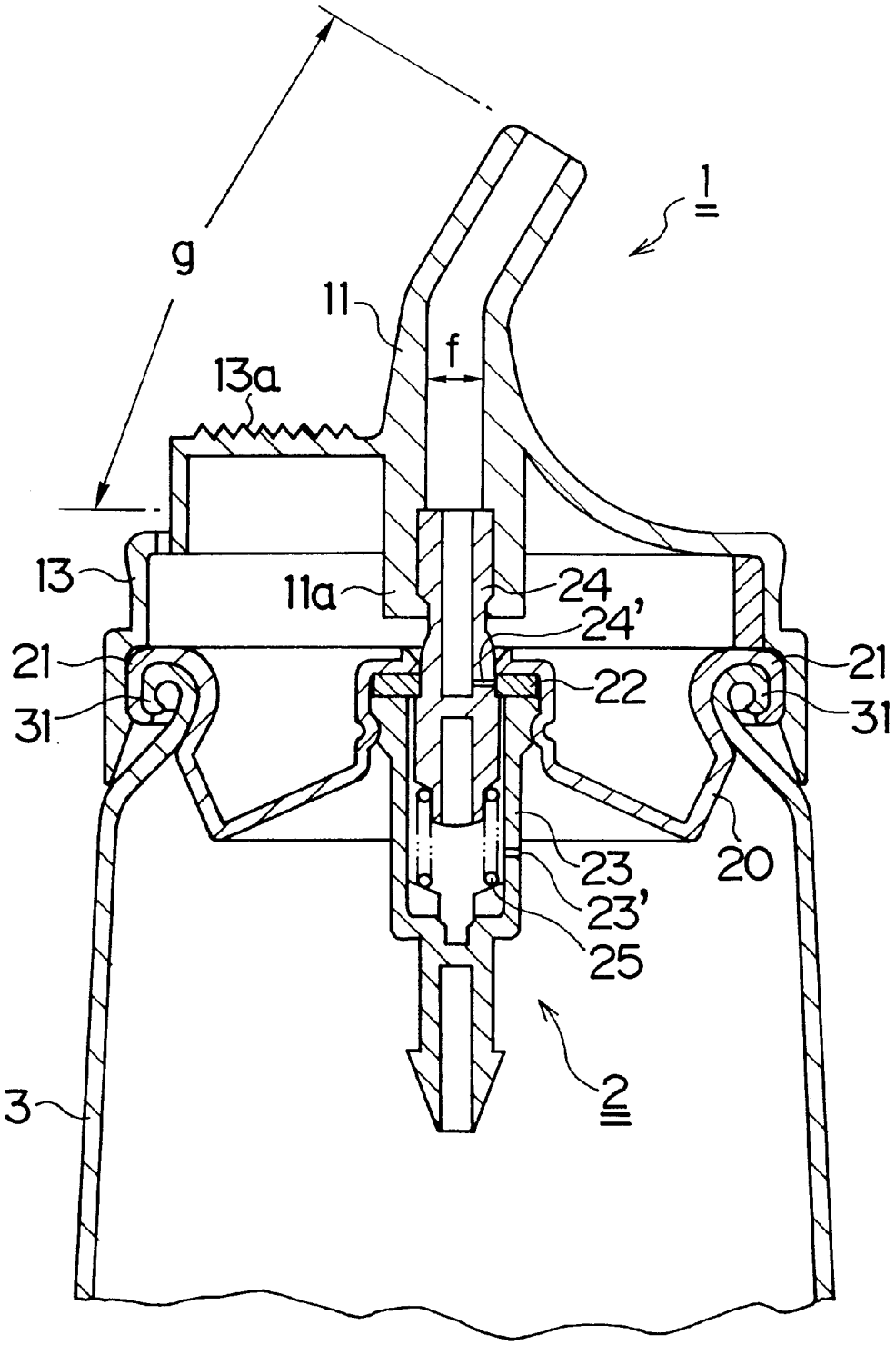
FIG. 4 (PRIOR ART)
FIG. 4 is a partial cross-sectional view of a dispensing Xn structure for aerosol containers according to the prior art, I shown for comparison with the dispensing structure for aerosol co 3 containers illustrated in FIG. 1.

The results of dispensing tests under the following conditions using aerosol containers equipped with the dispensers illustrated in FIGS. 1, 4 and 5 are stated in Table 1 below as Examples 1 through 3 and Comparative Examples 1 through 4. In Comparative Example 4, the test was carried out using the dispenser shown in FIG. 1. The signs used in the column of "Characteristics of nozzle shape" in Table 1 are as follows.

b: Bore of the larger dispensing port (1*a*)

c: Length of the larger dispensing port (1*a*)

d: Bore of the smaller dispensing port (10*a*)

e: Length of the smaller dispensing port (10*a*)

f: Bore of the hollow in the dispensing guide (11)

g: Length of the hollow in the dispensing guide (11)

h: Bore of the smaller dispensing port (12*a*) of the dispensing nozzle (12)

i: Length of the smaller dispensing port (12*a*) of the dispensing nozzle (12) The "discharge rate", "average particle size", "scattering extent", "sense of coolness" and "overall evaluation" in Table 1 are measured or assessed as stated below.

Discharge rate

Two samples each of aerosol containers filled with an aerosol as described above, each fitted with a spout of a prescribed shape and size, were immersed in warm water of 25° C. for at least 30 minutes, and tested by dispensing for 5 seconds three times. Each time the dispensed quantities of the aerosol were measured followed by evaluation by the criteria stated below and the calculation of the average dispensed quantity and its ratio to a reference value.

The ratio to reference (%) in the Tables 1–3 below is based on the quantity in Comparative Example 1.

○: The average is not more than 2.60 g.

Δ: The average is not less than 2.61 g but not more than 2.99 g

X: The average is not less than 3.00 g.

Particle Size

The diameters of particles within a 3 cm range were measured with a laser grain size measuring instrument (MALVERN 2600c, a product of Malvern Instruments, U.K.), and evaluated by the following criterion.

○: The average particle size is not less than 70 μm.

X: The average particle size is less than 70 μm.

Scattering extent

Dispensing was performed for 3 seconds against a piece of filter paper at a distance of 3 cm, and the longer dimension of the dispensed aerosol scattered on the paper was measured with a pair of slide calipers, and evaluated by the following criterion.

○: The longer scattering dimension is not more than 8 cm.

Δ: The longer scattering dimension is not less than 9 cm, but not more than 18 cm.

X: The longer scattering dimension is not less than 19 cm.

Sense of Coolness

Dispensing was performed for 1 second against human skin at a distance of 3 cm, and the sense of coolness felt by the subject person was evaluated by the following criterion.

○: Cool

Δ: Somewhat cool

X: Not cool

Overall evaluation

The test results regarding the discharge rate, particle size, scattering extent, and sense of coolness were considered together, and evaluated by the following criterion.

○: The discharge rate is not more than 3 g; the particle size not less than 70 μm, the scattering extent not more than 8 cm; and coolness is felt.

X : Unsatisfactory in at least one aspect of evaluation.

TABLE 1

| No. | Characteristics of nozzle shape (mm) | Discharge rate 25° C., n = 2 containers × 3 times g/5 sec. (ratio to reference %) | | Average particle size (μm) | Scattering extent (cm) | Sense of coolness | Overall evaluation |
|---|---|---|---|---|---|---|---|
| Example 1 | b: 1.5, c: 14 | ○ | | ○ | ○ | ○ | |
| | d: 0.4, e: 5 | 2.53 | (65%) | 105.1 | 4 | 3 | ○ |
| Example 2 | b: 1.5, c: 14 | ○ | | ○ | ○ | ○ | |
| | d: 0.25, e: 5 | 2.20 | (57%) | 102.2 | 4 | 3 | ○ |
| Example 3 | b: 1.0, c: 14 | ○ | | ○ | ○ | ○ | |
| | d: 0.4, e: 5 | 2.59 | (67%) | 74.7 | 4 | 3 | ○ |
| Comparative | f: 1.5, g: 19 | X | | ○ | ○ | ○ | |
| Example 1 | | 3.87 | (100%) | 91.8 | 4 | 3 | X |
| Comparative | h: 0.4, i: 1 | X | | X | X | X | |
| Example 2 | f: 1.5, g: 18 | 3.18 | (82%) | 29.4 | 39 | 1 | X |
| Comparative | h: 0.3, i: 1 | Δ | | X | X | X | |
| Example 3 | f: 1.5, g: 18 | 2.97 | (77%) | 17.1 | 31 | 1 | X |
| Comparative | b: 0.6, c: 14 | ○ | | X | Δ | Δ | |
| Example 4 | d: 0.4, e: 5 | 2.55 | (66%) | 43.5 | 9 | 2 | X |

The results listed in Table 1 above reveal that an aerosol can be dispensed in a satisfactory manner while keeping its quantity under control when the spout (1) has a smaller dispensing port **(10*a*) having a bore d of not more than ϕ 0.5 mm, a larger dispensing port (1*a*)** having a bore b of ϕ 0.8 to 3 mm and a length c of not less than 5 mm.

The dispensing structure for aerosol containers according to the first embodiment of the present invention provides the following effects:

First, because it has a larger dispensing port **(1*a*) with a bore b of 0.8 to 3 mm and a length c of not less than 5 mm next to a smaller dispensing port (10*a*)** having a bore d of not more than 0.5 mm, a smaller quantity of aerosol can be dispensed while keeping the dispensed particle size of aerosol from becoming too fine.

Second, since the particle size of dispensed aerosol is prevented from becoming too fine while keeping the discharge rate under control, the range of scattering in dispensing is not expanded, and the product safety in respect of human inhalation during use can be ensured.

Third, even with the discharge rate restrained, the user can still feel the sense of coolness provided by an aerosol utilizing the heat of vaporization of the propellant.

Fourth, since the quantity of dispensed aerosol is restrained, the combustibility of any ingredient of the aerosol can also be kept under control. Therefore, the safety of the product can be further enhanced.

In the dispensing structure for aerosol containers according to the first embodiment of the present invention, though the spout (1) is shaped in a dogleg form, as the thin nozzle (10) is formed separately from and inserted into the dispensing guide (11) after it is formed, the spout (1) can be easily configured.

EMBODIMENT 2

Figure 2:
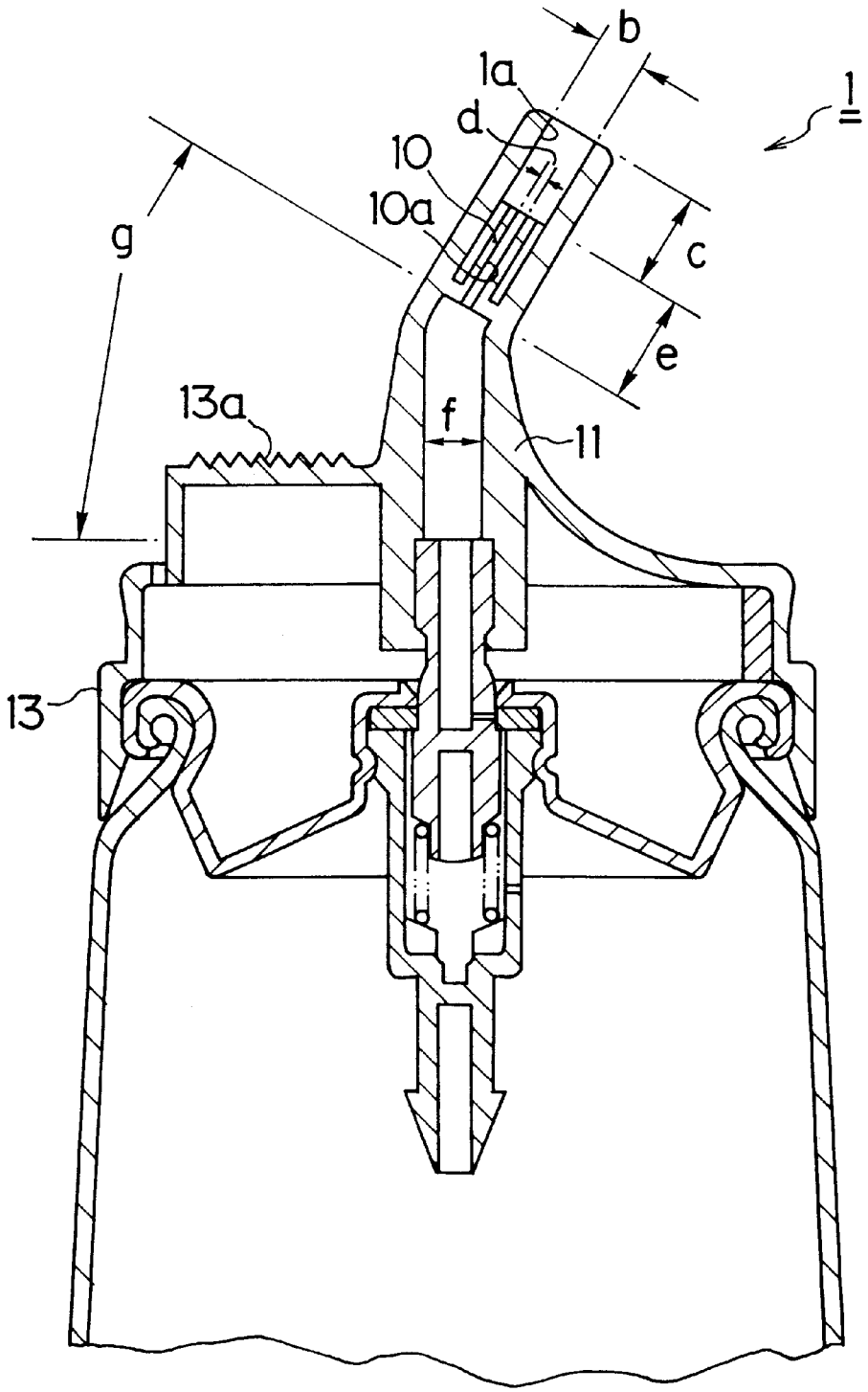
FIG. 2 is a partial cross-sectional view of a second embodiment of the dispensing structure for aerosol containers according to the invention.

In a dispenser structure for aerosol containers according to the second embodiment of the present invention, illustrated in FIG. 2, a spout (1) has its thin nozzle (10) with a smaller dispensing port **(10*a*) integrally formed in a position ahead of the base end of a dispensing guide (11)** toward the tip.

Figure 6:
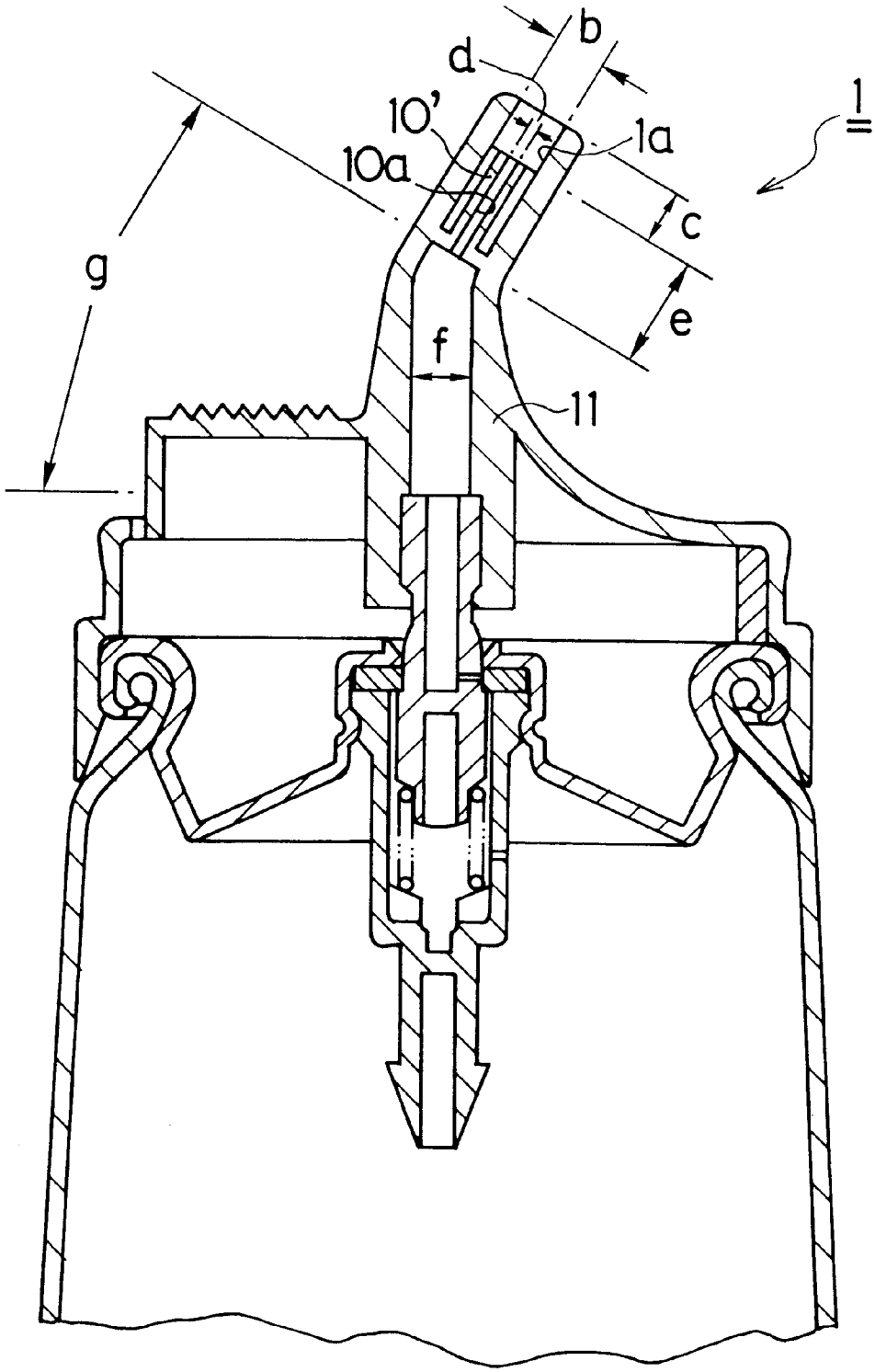
FIG. 6 (PRIOR ART)
FIG. 6 is a partial cross-sectional view of still another dispensing structure for aerosol containers according to the prior art, shown for comparison with the dispensing structure for aerosol containers illustrated in FIG. 2.

The results of dispensing tests using aerosol containers equipped with the dispensers illustrated in FIGS. 2 and 6 under the same conditions as for Embodiment 1 are stated in Table 2 below as Example 4 and Comparative Example 5.

TABLE 2

| No. | Characteristics of nozzle shape (mm) | Discharge rate 25° C., n = 2 containers × 3 times g/5 sec. (ratio to reference %) | Average particle size (μm) | Scattering extent (cm) | Sense of coolness | Overall evaluation |
|---|---|---|---|---|---|---|
| Example 4 | b: 1.5, c: 7 | ○ | ○ | ○ | ○ | |
| | d: 0.4, e: 5 | | | | | ○ |
| | b: 1.5, c': 10 | 2.55 (66%) | 80.1 | 4 | 3 | |
| Comparative | b: 1.5, c: 4 | ○ | X | Δ | X | |
| Example 5 | d: 0.4, e: 5 | | | | | X |
| | b: 1.5, c': 10 | 2.60 (67%) | 25.6 | 10 | 1 | |

The results listed in Table 2 above reveal that an aerosol can be dispensed in a satisfactory manner when the dispenser (1) has a smaller dispensing port **(10*a*) with a bore d of not more than 0.5 mm, a larger dispensing port (1*a*)** with a bore b of 0.8 to 3 mm and a length c of not less than 5 mm.

Whereas the dispenser (1) has its thin nozzle (10) with the smaller dispensing port **(10*a*) integrally formed in a position downstream of the base end of the nozzle or dispensing guide (11)** and toward its distal end, according to the second embodiment of the invention, this structure also provides effects similar to the dispenser according to the first embodiment and, moreover, can help reduce the manufacturing cost.

Since the other aspects of the configuration, actions and effects of the dispenser for aerosol containers according to the second embodiment of the invention are substantially the same as those according to the first embodiment described above, their description is omitted.

EMBODIMENT 3

Figure 3:
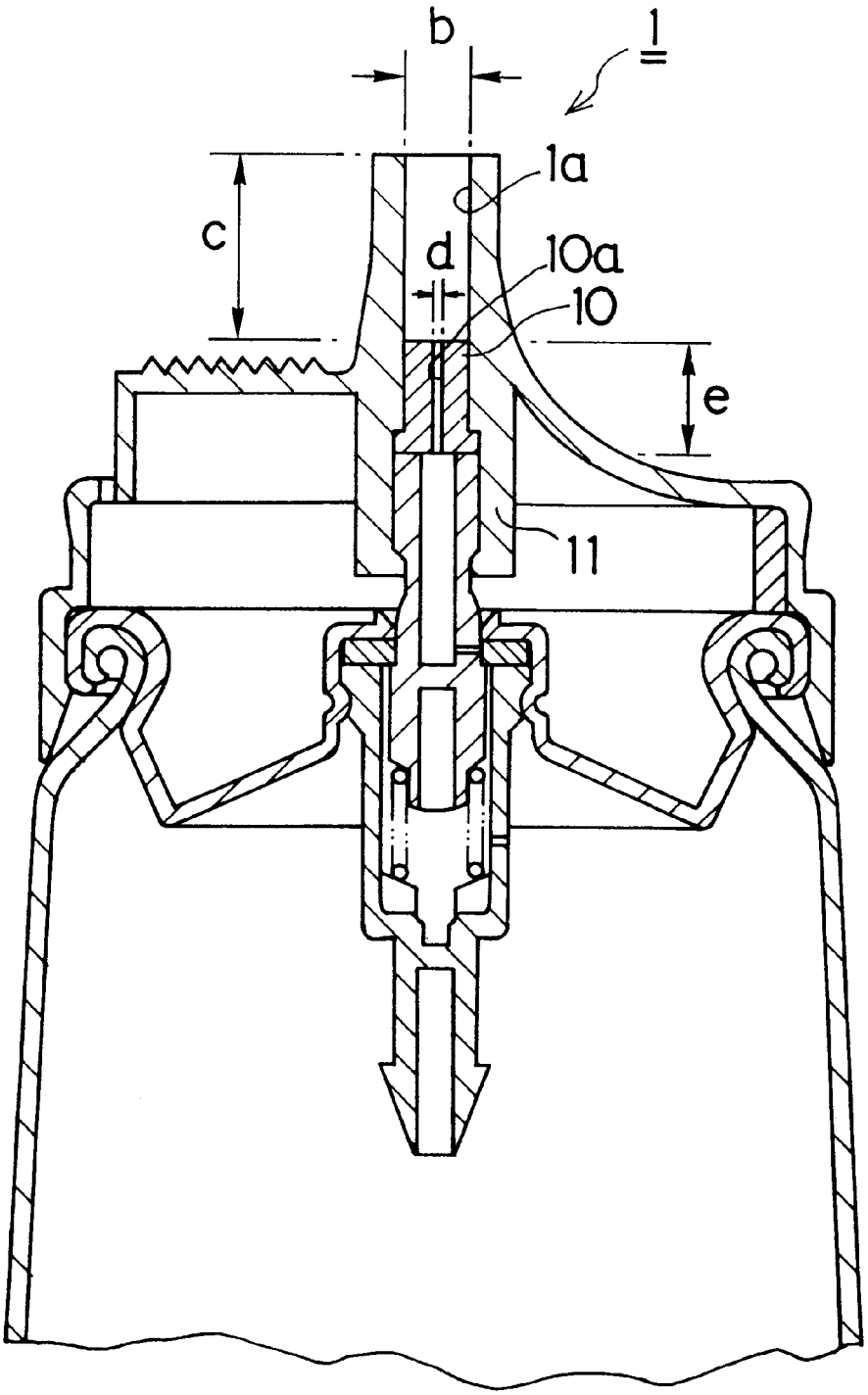
FIG. 3 is a partial cross-sectional view of a third embodiment of the dispensing structure for aerosol containers . according to the invention.

In a dispensing structure for aerosol containers according to the third embodiment of the present invention, illustrated in FIG. 3, a dispenser (1) has its nozzle or dispensing guide (11) formed extending vertically from inside to outside the central part of the top face, and other aspects of the configuration are the same as the first embodiment of the invention.

Figure 7:
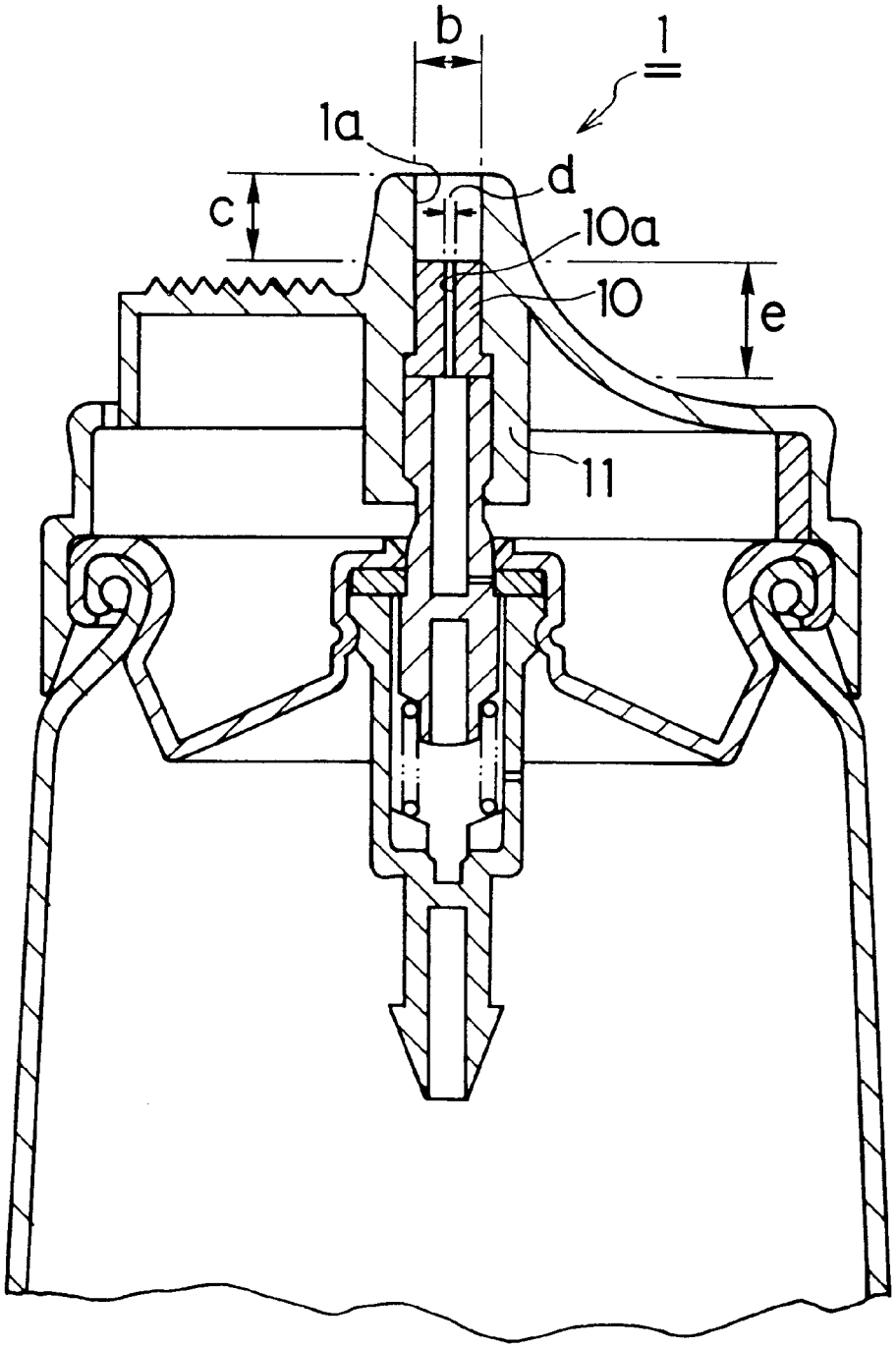
FIG. 7 (PRIOR ART)
FIG. 7 is a partial cross-sectional view of yet another dispensing structure for aerosol containers according to the prior art, shown for comparison with the dispensing structure for aerosol containers illustrated in FIG. 3.

The results of dispensing tests using aerosol containers equipped with the dispensers illustrated in FIGS. 3 and 7 under the same conditions as for Embodiment 1 are stated in Table 3 below as Examples 5 and 6 and Comparative Examples 6 and 7.

TABLE 3

| No. | Characteristics of nozzle shape (mm) | Discharge rate 25° C., n = 2 containers × 3 times g/5 sec. (ratio to reference %) | Average particle size (μm) | Scattering extent (cm) | Sense of coolness | Overall evaluation |
|---|---|---|---|---|---|---|
| Example 5 | b: 1.5, c: 11 | ○ | ○ | ○ | ○ | |
| | d: 0.4, e: 5 | 2.39 (62%) | 83.6 | 6 | 3 | ○ |
| Example 6 | b: 1.5, c: 6 | ○ | ○ | ○ | ○ | |
| | d: 0.4, e: 5 | 2.41 (62%) | 72.6 | 7 | 3 | ○ |
| Comparative | b: 1.5, c: 4 | ○ | X | X | X | |
| Example 6 | d: 0.4, e: 5 | 2.49 (64%) | 34.2 | 19 | 1 | X |
| Comparative | b: 1.5, c: 2 | ○ | X | X | X | |
| Example 7 | d: 0.4, e: 5 | 2.59 (67%) | 20.2 | 25 | 1 | X |

The results listed in Table 3 above reveal that an aerosol can be dispensed in a satisfactory manner when the dispenser (1) has a smaller dispensing port **(10*a*) with a bore d of not more than 0.5 mm, a larger dispensing port (1*a*)** with a bore b of 0.8 to 3 mm and a length c of not less than 5 mm.

As the dispenser (1) has its thin nozzle (10) formed in a vertical direction according to the second embodiment of the invention, it provides a further effect of satisfactorily dispensing an aerosol at a angle different from the dispenser described above as the second embodiment.

Since the other actions and effects of the dispensing structure for aerosol containers according to the third embodiment of the invention are substantially the same as those for aerosol containers according to the first embodiment described above, their description is omitted.

Dispenser structures for aerosol containers according to the present invention are not limited to the above-described embodiments, but include modifications to which other elements are added or some constituent elements are replaced with other equivalent means within the scope of the appended claims.

For instance, the dispensing valve (2) may have some other structure, or the aerosol in the container (3) may have some other composition than what was stated above by way of example.

What is claimed is:

1. A dispenser for an aerosol container comprising:

a first nozzle having a bore extending therethrough of a diameter b, said bore terminating at the distal end of said nozzle at a distal opening of diameter b, wherein b is 0.8 to 3.0 mm; and a second nozzle within said bore of said first nozzle and spaced from said distal opening by a length c of at least 5 mm, said second nozzle having a bore extending therethrough of a diameter d of not more than 0.5 mm.

2. A dispenser for aerosol containers, as claimed in claim 1, wherein said bore of said second nozzle has a length e of 2 to 20 mm.

3. A dispenser for aerosol containers, as claimed in claim 1, wherein said second nozzle is a separate member inserted into said first nozzle.

4. A dispenser for aerosol containers, as claimed in claim 1, wherein said second nozzle is formed integrally with said first nozzle.

5. A dispenser mounted within a top of an aerosol container comprising:

a cylindrical valve member having a first bore and mounted within the top of the container for reciprocable movement between a dispensing position wherein communication is established between said first bore and contents within the aerosol container and a closed position;

a flexible cap covering the top of the aerosol container and connected to said valve member whereby pressing said flexible cap moves said valve member from the closed position to the dispensing position;

a first nozzle connected to said flexible cap and having a second bore extending therethrough of a diameter b, said second bore terminating at the distal end of said first nozzle at a distal opening of diameter b, wherein b is 0.8 to 3.0 mm; and a second nozzle within said second bore and spaced from said distal opening by a length c of at least 5 mm, said second nozzle having a third bore extending therethrough of a diameter d of not more than 0.5 mm, one end of said second nozzle abutting one end of said valve member to provide direct communication and coaxial alignment between said first and third bores, said first bore having a larger diameter than said third bore.

6. A dispenser according to claim 5 further comprising:

a spring biasing said valve member toward said closed position.

7. A dispenser according to claim 5 wherein said third bore has a length c of 2 to 20 mm.

8. A dispenser according to claim 5 wherein said second nozzle is a separate member inserted into said first nozzle.

9. A dispenser according to claim 5 wherein said second nozzle is formed integrally with said first nozzle.

* * * * *